US005167766A

United States Patent [19]

Honig et al.

[11] Patent Number: 5,167,766

[45] Date of Patent: Dec. 1, 1992

[54] CHARGED ORGANIC POLYMER MICROBEADS IN PAPER MAKING PROCESS

[75] Inventors: Dan S. Honig, New Canaan; Elieth Harris, Bridgeport, both of Conn.

[73] Assignee: American Cyanamid Company, Stamford, Conn.

[21] Appl. No.: 540,667

[22] Filed: Jun. 18, 1990

Related U.S. Application Data

[63] Continuation-in-part of Ser. No. 536,382, Jun. 11, 1990, abandoned.

[51] Int. Cl.[5] ..... D21H 17/03

[52] U.S. Cl. ..... 162/164.1; 162/168.1; 162/168.3

[58] Field of Search ..... 162/164.1, 164.6, 168.1, 162/168.2, 168.3, 175, 181.2; 210/734, 735; 524/52, 555

[56] References Cited

U.S. PATENT DOCUMENTS

| | | | |
|---|---|---|---|
| 3,702,799 | 11/1972 | Lewis et al. | 162/168.4 |
| 4,643,801 | 2/1987 | Johnson | 162/164.6 |
| 4,659,431 | 4/1987 | Probst et al. | 162/168.2 |
| 4,753,710 | 6/1988 | Langley et al. | 162/164.3 |
| 4,759,856 | 7/1988 | Farrar et al. | 162/168.3 |
| 4,798,653 | 1/1989 | Rushmere | 162/168.3 |
| 4,824,523 | 4/1989 | Wagberg et al. | 162/164.6 |
| 4,925,530 | 5/1990 | Sinclair et al. | 162/164.6 |
| 4,968,435 | 11/1990 | Neff et al. | 210/732 |

*Primary Examiner*—W. Gary Jones
*Assistant Examiner*—Charles K. Friedman
*Attorney, Agent, or Firm*—Frank M. Van Riet

[57] ABSTRACT

In a papermaking process, improved drainage and retention are obtained when ionic, organic microbeads of less than about 1,000 nm in diameter if crosslinked or less about than 60 nm in diameter if noncrosslinked are added either alone or in combination with a high molecular weight organic polymer, and/or polysaccharide. Further addition of alum enhances drainage formation and retention properties in papermaking stock with and without the present of other additives used in papermaking processes.

28 Claims, No Drawings

CHARGED ORGANIC POLYMER MICROBEADS IN PAPER MAKING PROCESS

BACKGROUND OF THE INVENTION

In the past decade, the concept of using colloidal silica and bentonite to improve drainage, formation and retention has been introduced to papermaking. Fast drainage and greater retention of fines contribute to lower cost in papermaking and improvements are always being sought. U.S. Pat. Nos. 4,388,150 and 4,385,961 disclose the use of a two-component binder system comprising a cationic starch and an anionic, colloidal, silicic acid sol as a retention aid when combined with cellulose fibers in a stock from which is made. Finnish Published Specification Nos. 67,735 and 67,736 refer to cationic polymer retention agent compounds including cationic starch and polyacrylamide as useful in combination with an anionic silica to improve sizing. U.S. Pat. No. 4,798,653 discloses the use of cationic colloidal silica sol with an anionic copolymer of acrylic acid and acrylamide to render the paper stock resistant to destruction of its retention and dewatering properties by shear forces in the paper-making process. A coacervate binder, three component system composed of a cationic starch, an anionic high molecular weight polymer and dispersed silica having a particle diameter range from 1 to 50 nm is revealed in U.S. Pat. Nos. 4,643,801 and 4,750,974.

The above Finish publications also disclose the use of bentonite with cationic starch and polyacrylamides. U.S. Pat. No. 4,305,781 discloses a bentonite-type clay in combination with high molecular weight, substantially non-ionic polymers such as polyethylene oxides and polyacrylamide as a retention aid. Later, in U.S. Pat. No. 4,753,710, bentonite and a substantially linear, cationic polymer such as cationic acrylic polymers, polyethylene imine, polyamine epichlorohydrin, and diallyl dimethyl- ammonium chloride are claimed to give an improved combination of retention, drainage, drying and formation.

It is noted that the silica sol and bentonite are inorganic microparticle materials.

Latices of organic microparticles have been used in high concentrations of 30–70 lbs/ton to give "high-strength" paper products such as gasket materials, roofing felt, paperboard and floor felt and in paper with 30–70% mineral fillers (U.S. Pat. No. 4,445,970). It is stated that latices have not been used in fine papermaking because such latices are sticky and difficult to use on a Fourdrinier machine. The latices of the above and following four patent references were made according to U.S. Pat. No. 4,056,501. They are all emulsions of polymers made from styrene, butadiene and vinylbenzyl chloride which polymers are reacted with trimethylamine or dimethyl sulfide to produce an "onium" cation which is called a pH independent structured latex of 50 to 1000 nm in diameter. These structured cationic latices are used at high levels of concentration i.e. 30–200 lbs/ton either alone (U.S. Pat. No. 4,178,205) or with an anionic, high molecular weight polymer, (U.S. Pat. No. 4,187,142) or with an anionic polymer (U.S. Pat. No. 4,189,345) or as both cationic and anionic latices (U.S. Pat. No. 4,225,383). These latices are preferably from 60–300 nm in size It has been found, in accordance with the present invention, that noncrosslinked organic microbeads of this size and larger are not effective. Furthermore, the process of the present invention uses organic microbeads at a level of 0.05 to 20 lbs/ton, preferably 0.10 to 7.5 lbs/ton whereas the microbeads of the proceeding five U.S. Patent are used at 30–200 lbs/ton to give strength to paper products such as gaskets with a very high 30–70% mineral content. This prior art does not contemplate the use of charged organic micro-beads as a drainage and retention aid at the very low levels as required by the present invention.

The use of an organic crosslinked microbead, in papermaking is taught in Japanese Patent Tokkai JP235596/63:1988 and Kami Pulp Gijitsu Times, pgs 1–5, March 1989 as a dual system of a cationic or anionic organic microbead of 1–100 microns and an anionic, cationic or nonionic acrylamide polymer. The waterswelling type, cationic, polymer particle is a crosslinked homopolymer of 2-methacryloyloxyethyl trimethylammonium chloride or a crosslinked copolymer of 2-methacryloyloxy-ethyl trimethylammonium chloride/acrylamide (60/40 weight percent). The acrylamide polymer is an acrylamide homopolymer or acrylamide hydroylsate of 17 mole percent anion-conversion or a copolymer of acrylamide/2-methacryloyloxyethyl trimethylammoniumchloride (75/25 weight percent). The anionic microbead is an acrylamide-acrylic acid copolymer.

EPO 0273605 teaches the addition of microbeads having a diameter ranging from about 49–87 nm and produced from terpolymers of vinyl acetate (84.6), ethyl acrylate (65.4) and acrylic acid (4.5) or methacrylonitrile (85), butyl acrylate (65) and acrylic acid (3). These polymeric beads are disclosed as added to an LBKP pulp slurry in order to evaluate the resultant paper for sizing degree, paper force enhancement and disintegratability. These polymer beads fall outside the scope of those used in the present invention in that the ionic content thereof is too small to impart any appreciable improvement in retention and drainage in the papermaking process.

The present invention encompasses crosslinked, ionic, organic, polymeric microbeads of less than about 750 nm in diameter or microbeads of less than about 60 nm in diameter if noncrosslinked and water-insoluble, as a retention and drainage aid, their use in papermaking processes, and compositions thereof with high molecular weight polymers and/or polysaccharides.

EP 0,202,780 describes the preparation of crosslinked, cationic, polyacrylamide beads by conventional inverse emulsion polymerization techniques. Crosslinking is accomplished by the incorporation of difunctional monomer, such as methylenebisacrylamide, into the polymer chain. This crosslinking technology is well known in the art. The patent teaches that the crosslinked beads are useful as flocculants but are more highly efficient after having been subjected to unusual levels of shearing action in order to render them water-soluble.

Typically, the particle size of polymers prepared by conventional, inverse, water-in-oil, emulsion, polymerization processes are limited to the range of 1–5 microns, since no particular advantage in reducing the particle size has hitherto been apparent. The particle size which is achievable in inverse emulsions is determined by the concentration and activity of the surfactant(s) employed and these are customarily chosen on the basis of emulsion stability and economic factors.

The present invention is directed to the use, in papermaking, of cationic and anionic, crosslinked, polymeric, microbeads. Microgels are made by standard techniques and microlatices are purchased commercially. The polymer microbeads are also prepared by the optimal use of a variety of high activity- surfactant or surfactant mixtures to achieve submicron size. The type and concentration of surfactant should be chosen to yield a particle size of less than about 750 nm in diameter and more preferably less than about 300 nm in diameter.

SUMMARY OF THE INVENTION

According to the present invention, there is provided a method of making paper from a aqueous suspension of cellulosic papermaking fibers, whereby improved drainage, retention and formation properties are achieved. The method comprises adding to the suspension, from about 0.05 to 20 lbs/ton of an ionic, organic polymer microbead of less than about 750 nanometers in diameter if crosslinked or a polymeric microbead of less than about 60 nm in diameter if noncrosslinked and insoluble. Additionally, from about or 0.05 to about 20 lbs/ton, preferably about 0.1-5.0 lbs/ton, of a high molecular weight, hydrophilic ionic organic polymer, and/or from about 1.0 to about 50.0, preferably about 5.0-30.0, lbs/ton of an ionic polysaccharide, such as starch, preferably of a charge opposite that of the microbead, may be used. The synthetic organic polymer and polysaccharide may also be of opposite charge to each other. The addition of the microbead compositions results in significant increase in fiber retention and improvement in drainage and formation, said lbs/ton being based on the dry weight of the paper furnish solids. The organic polymer microbeads may be either cationic or anionic.

Alum or any other active, soluble aluminum species such as polyhydroxyaluminum chloride and/or sulfate and mixtures thereof have been found to enhance drainage rates and retention if they are incorporated into the furnish when used with the microbead compositions 0.1 to 20 lbs/ton, as alumina, based on the dry weight of paper furnish solids, are exemplary.

The microbeads may be made as microemulsions by a process employing an aqueous solution comprising a cationic or anionic monomer and crosslinking agent; an oil comprising a saturated hydrocarbon; and an effective amount of a surfactant sufficient to produce particles of less than about 0.75 micron in unswollen number average particle size diameter. Microbeads are also made as microgels by procedures described by Ying Huang et. al., Makromol. Chem. 186, 273-281 (1985) or may be obtained commercially as microlatices. The term "microbead", as used herein, is meant to include all of these configurations, i.e. beads per se, microgels and microlatices.

Polymerization of the emulsion may be carried out by adding a polymerization initiator, or by subjecting the emulsion to ultraviolet irradiation. An effective amount of a chain transfer agent may be added to the aqueous solution of the emulsion, so as to control the polymerization. It was surprisingly found that the crosslinked, organic, polymeric microbeads have a high efficiency as retention and drainage aids when their particle size is less than about 750 nm in diameter and preferably less than about 300 nm in diameter and that the noncrosslinked, organic, water-insoluble polymer microbeads have a high efficiency when their size is less than about 60 nm. The efficiency of the crosslinked microbeads at a larger size than the noncrosslinked microbeads may be attributed to the small strands or tails that protrude from the main crosslinked polymer.

DETAILED DESCRIPTION OF THE INVENTION INCLUDING PREFERRED EMBODIMENTS

Using the ionic, organic, crosslinked, polymeric microbeads of a diameter less than about 750 nm or the noncrosslinked, water-insoluble beads of less than about 60 nm in diameter according to this invention, improved drainage, formation and greater fines and filler retention values are obtained in papermaking processes. These additives may be added, alone or in conjunction with other materials, as discussed below, to a conventional paper making stock such as traditional chemical pulps, for instance, bleached and unbleached sulphate or sulphite pulp, mechanical pulp such as groundwood, thermomechanical or chemi-thermomechanical pulp or recycled pulp such as deinked waste and any mixtures thereof. The stock, and the final paper, can be substantially unfilled or filled, with amounts of up to about 50%, based on the dry weight of the stock, or up to about 40%, based on dry weight of paper of filler, being exemplary. When filler is used any conventional filler such as calcium carbonate, clay, titanium dioxide or talc or a combination may be present. The filler, if present, may be incorporated into the stock before or after addition of the microbeads. Other standard paper-making additives such as rosin sizing, synthetic sizings such as alkyl succinic anhydride and alkyl ketene dimer, alum, strength additives, promoters, polymeric coagulants such as low molecular weight polymers, dye fixatives, etc. and other materials that are desirable in the papermaking process, may also be added.

The order of addition, specific addition points, and furnish modification itself are not critical and normally will be based on practicality and performace for each specific application, as is common papermaking practise.

When using cationic, high molecular weight polymer(s), or polysaccharides, and anionic microbeads, the preferred sequence of addition is cationic, high molecular weight polymer and then anionic bead. However, in some cases the reverse may be used. When a cationic polysaccharide such as starch and a cationic polymer are both used, they can be added separately or together, and in any order. Furthermore, their individual addition may be at more than one point The anionic microbeads may be added before any cationic components or after them with the latter being the preferred method. Split addition may also be practised. Preferred practise is to add cationic polysaccharide before high molecular weight cationic polymer. The furnish may already have cationic starch, alum, cationic (or anionic or both cationic and anionic) polymers of molecular weight equal or less than 100,000, sodium aluminate, and basic aluminum salts (e.g., polyaluminum chloride and/or sulfate) and their levels may be varied to improve the response of the furnish, as discussed above. Addition points are those typically used with dual retention & drainage systems (pre-fan pump or pre-screen for one component and pre- or post-screens for another). However, adding the last component before the fan pump may be warranted in some cases. Other addition points that are practical can be used if better performance or convenience is obtained. Thick stock addition of one component is also possible, although thin stock addition is preferred. However, thick stock and/or split thick and thin stock addition of cationic starch is routinely practised and these addition modes are applicable with the use of the microbead as well. Addition points will be determined by practicality and by the possible need to put more or less shear on the treated system to ensure good formation.

When using high molecular weight, anionic polymer(s) and cationic microbeads, the preferred sequence is anionic polymer and then cationic beads, although in some cases the reverse may be used. When anionic polymer and anionic polysaccharide are both used, they can be added separately or together, and in any order.

The microbeads may also be used in combination with high molecular weight ionic polymers of similar or opposite charge.

The microbeads are crosslinked, cationic or anionic, polymeric, organic microparticles having an unswollen number average particle size diameter of less than about 750 nanometers and a crosslinking agent content of above about 4 molar parts per million based on the monomeric units present in the polymer and are generally formed by the polymerization of at least one ethylenically unsaturated cationic or anionic monomer and, optionally, at least one non-ionic comonomer in the presence of said crosslinking agent. They preferably have a solution viscosity (SV) of about 1.1–2.0 mpa.s.

Cationic microbeads used herein include those made by polymerizing such monomers as diallyldialkylammmonium halides; acryloxyalkyltrimethylammonium chloride; (meth)acrylates of dialkylaminoalkyl compounds, and salts and quaternaries thereof and, monomers of N,N-dialkylaminoalkyl(meth)acrylamides, and salt and quaternaries thereof, such as N,N-dimethyl aminoethylacrylamides; (meth)acrylamidopropyltrimethylammonium chloride and the acid or quaternary salts of N,N-dimethylaminoethylacrylate and the like. Cationic monomers which may be used herein are of the following general formulae:

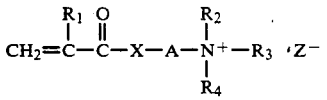

(I)

where $R_1$ is hydrogen or methyl, $R_2$ is hydrogen or lower alkyl of $C_1$ to $C_4$, $R_3$ and/or $R_4$ are hydrogen, alkyl of $C_1$ to $C_{12}$, aryl, or hydroxyethyl and $R_2$ and $R_3$ or $R_2$ and $R_4$ can combined to form a cyclic ring containing one or more hetero atoms, Z is the conjugate base of an acid, X is oxygen or $—NR_1$ wherein $R_1$ is as defined above, and A is an alkylene group of $C_1$ to $C_{12}$; or

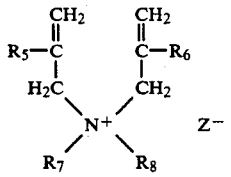

(II)

where $R_5$ and $R_6$ are hydrogen or methyl, $R_7$ is hydrogen or alkyl of $C_1$ to $C_{12}$ and $R_8$ is hydrogen, alkyl of $C_1$ to $C_{12}$, benzyl or hydroxyethyl; and Z is as defined above.

Anionic microbeads that are useful herein those made by hydrolyzing acrylamide polymer microbeads etc. those made by polymerizing such monomers as (methyl)acrylic acid and their salts, 2-acrylamido-2-methylpropane sulfonate, sulfoethyl-(meth)acrylate, vinylsulfonic acid, styrene sulfonic acid, maleic or other dibasic acids or their salts or mixtures thereof.

Nonionic monomers, suitable for making microbeads as copolymers with the above anionic and cationic monomers, or mixtures thereof, include (meth)acrylamide; N-alkyacrylamides, such as N-methylacrylamide; N,N-dialkylacrylamides, such as N,N-dimethylacrylamide; methyl acrylate; methyl methacrylate; acrylonitrile; N-vinyl methylacetamide; N-vinyl methyl formamide; vinyl acetate; N-vinyl pyrrolidone, mixtures of any of the foregoing and the like.

These ethylenically unsaturated, non-ionic monomers may be copolymerized, as mentioned above, to produce cationic, anionic or amphoteric copolymers. Preferably, acrylamide is copolymerized with an ionic and/or cationic monomer. Cationic or anionic copolymers useful in making microbeads comprise from about 0 to about 99 parts, by weight, of non-ionic monomer and from about 100 to about 1 part, by weight, of cationic or anionic monomer, based on the total weight of the anionic or cationic and non-ionic monomers, preferably from about 10 to about 90 parts, by weight, of non-ionic monomer and about 10 to about 90 parts, by weight, of cationic or anionic monomer, same basis i.e. the total ionic charge in the microbead must be greater than about 1%. Mixtures of polymeric microbeads may also be used if the total ionic charge of the mixture is also over about 1%. If the anionic microbead is used alone, i.e. in the absence of high molecular weight polymer or polysaccharide, in the process of the present invention, the total anionic charge thereof must be at least about 5%. Most preferably, the microbeads contain from about 20 to 80 parts, by weight, of non-ionic monomer and about 80 to about 20 parts by weight, same basis, of cationic or anionic monomer or mixture thereof. Polymerization of the monomers occurs in the presence of a polyfunctional crosslinking agent to form the crosslinked microbead. Useful polyfunctional crosslinking agents comprise compounds having either at least two double bounds, a double bond and a reactive group, or two reactive groups. Illustrative of those containing at least two double bounds are N,N-methylenebisacrylamide; N,N-methylenebismethacrylamide; polyethyleneglycol diacrylate; polyethyleneglycol dimethacrylate; N-vinyl acrylamide; divinylbenzene; triallylommonium salts, N-methylallylacrylamide and the like. Polyfunctional branching agents containing at least one double bond and at least one reactive group include glycidyl acrylate; glycidyl methacrylate; acrolein; methylolacrylamide and the like. Polyfunctional branching agents containing at least two reactive groups include dialdehydes, such as gyloxal; diepoxy compounds; epichlorohydrin and the like.

Crosslinking agents are to be used in sufficient quantities to assure a cross-linked composition. Preferably, at least about 4 molar parts per million of crosslinking agent based on the monomeric units present in the polymer are employed to induce sufficient crosslinking and especially preferred is a crosslinking agent content of from about 4 to about 6000 molar parts per million, most preferably, about 20–4000.

The polymeric microbeads of this invention are preferably prepared by polymerization of the monomers in an emulsion as disclosed in application, Ser. No. 07/535,626 filed June 11, 1990. Polymerization in microemulsions and inverse emulsions may be used as is known to those skilled in this art. P. Speiser reported in 1976 and 1977 a process for making spherical "nanoparticles" with diameters less than 800 Å by (1) solubilizing monomers, such as acrylamide and methylenebisacrylamide, in micelles and (2) polymerizing the monomers, See J. Pharm. Sa., 65(12), 1763 (1976) and U.S. Pat. No. 4,021,364. Both inverse water-in-oil and oil-in-water "nanoparticles" were prepared by this process. While not specifically called microemulsion polymerization by the author, this process does contain all the features which are currently used to define microemulsion polymerization. These reports also constitute the first examples of polymerization of acrylamide in a microemulsion. Since then, numerous publications reporting polymerization of hydrophobic monomers in the oil phase of microemulsions have appeared. See, for examples, U.S. Pat. Nos. 4,521,317 and 4,681,912; Stoffer and Bone, J. Dispersion Sci. and Tech., 1(1), 37, 1980; and Atik and Thomas J. Am. Chem. Soc., 103 (14), 4279 (1981); and GB 2161492A.

The cationic and/or anionic emulsion polymerization process is conducted by (i) preparing a monomer emulsion by adding an aqueous solution of the monomers to a hydrocarbon liquid containing appropriate surfactant or surfactant mixture to form an inverse monomer emulsion consisting of small aqueous droplets which, when polymerized, result in polymer particles of less than 0.75 micron in size, dispersed in the continuous oil phase and (ii) subjecting the monomer microemulsion to free radical polymerization.

The aqueous phase comprises an aqueous mixture of the cationic and/or anionic monomers and optionally, a non-ionic monomer and the crosslinking agent, as discussed above. The aqueous monomer mixture may also comprise such conventional additives as are desired For example, the mixture may contain chelating agents to remove polymerization inhibitors, pH adjusters, initiators and other conventional additives.

Essential to the formation of the emulsion, which may be defined as a swollen, transparent and thermodynamically stable emulsion comprising two liquids insoluble in each other and a surfactant, in which the micelles are less than 0.75 micron in diameter, is the selection of appropriate organic phase and surfactant.

The selection of the organic phase has a substantial effect on the minimum surfactant concentration necessary to obtain the inverse emulsion. The organic phase may comprise a hydrocarbon or hydrocarbon mixture. Saturated hydrocarbons or mixtures thereof are the most suitable in order to obtain inexpensive formulations. Typically, the organic phase will comprise benzene, toluene, fuel oil, kerosene, odorless mineral spirits or mixtures of any of the foregoing.

The ratio, by weight, of the amounts of aqueous and hydrocarbon phases is chosen as high as possible, so as to obtain, after polymerization, an emulsion of high polymer content. Practically, this ratio may range, for example for about 0.5 to about 3:1, and usually approximates about 1:1, respectively.

The one or more surfactants are selected in order to obtain HLB (Hydrophilic Lipophilic Balance) value ranging from about 8 to about II. Outside this range, inverse emulsions are not usually obtained In addition to the appropriate HLB value, the concentration of surfactant must also be optimized, i.e. sufficient to form an inverse emulsion. Too low a concentration of surfactant leads to inverse emulsions of the prior art and too high a concentrations results in undue costs. Typical surfactants useful, in addition to those specifically discussed above, may be anionic, cationic or nonionic and may be selected from polyoxyethylene (20) sorbitan trioleate, sorbitan trioleate, sodium di-2-ethylhexylsulfosuccinate, oleamidopropyldimethylamine; sodium isostearyl-2-lactate and the like.

Polymerization of the emulsion may be carried out in any manner known to those skilled in the art. Initiation may be effected with a variety of thermal and redox free-radical initiators including azo compounds, such as azobisisobutyronitrile; peroxides, such as t-butyl peroxide; organic compounds, such as potassium persulfate and redox couples, such as ferrous ammonium sulfate/ammonium persulfate. Polymerization may also be effected by photochemical irradiation processes, irradiation, or by ionizing radiation with a $^{60}Co$ source. Preparation of an aqueous product from the emulsion may be effected by inversion by adding it to water which may contain a breaker surfactant. Optionally, the polymer may be recovered from the emulsion by stripping or by adding the emulsion to a solvent which precipitates the polymer, e.g. isopropanol, filtering off the resultant solids, drying and redispersing in water.

The high molecular weight, ionic, synthetic polymers used in the present invention preferably have a molecular weight in excess of 100,000 and preferably between about 250,000 and 25,000,000. Their anionicity and/or cationicity may range from 1 mole percent to 100 mole percent. The ionic polymer may also comprise homopolymers or copolymers of any of the ionic monomers discussed above with regard to the ionic beads, with acrylamide copolymers being preferred.

The degree of substitution of cationic starches (or other polysaccharides) and other non-synthetic based polymers may be from about 0.01 to about 1.0, preferably from about 0.02 to about 0.20. Amphoteric starches, preferably but not exclusively with a net cationic starch, may also be used. The degree of substitution of anionic starches (or other polysaccharides) and other non-synthetic-based polymers may be from 0.01 to about 0.7 or greater. The ionic starch may be made from starches derived from any of the common starch producing materials, e.g., potato starch, corn starch, waxy maize, etc. For example, a cationic potato starch made by treating potato starch with 3-chloro-2-hydroxypropyltrimethylammonium chloride. Mixtures of synthetic polymers and e.g. starches, may be used. Other polysaccharides useful herein include guar, cellulose derivatives such as carboxymethylcellulose and the like.

It is also preferred that the high molecular weight, ionic polymer be of a charge opposite that of the microbead and that if a mixture of synthetic, ionic polymers or starch be used, at least one be of a charge opposite that of the microbead. The microbeads may be used as such or may be replaced in part, i.e. up to about 50%, by weight, with bentonite or a silica such as colloidal silica, modified colloidal silica etc. and still fall within the scope of the percent invention.

The instant invention also relates to compositions of matter comprising mixtures of the above-described ionic microbeads, high molecular weight, ionic polymers and polysaccharides. More particularly, compositions comprising a mixture of A) an ionic, organic, polymer microbead of less than about 750 nanometers in diameter if cross-linked and less than 60 nanometers in diameter if non-cross-linked and water-insoluble and B) a high molecular weight ionic polymer, the ratio of A): B) ranging from about 1:400 to 400:1, respectively. Additionally, the compositions may contain the microbead A) and C) an ionic polysaccharide, the ratio of A):C) ranging from about 20:1 to about 1:1000, respectively. Still further, the compositions may contain the microbead A), the polymer B) and the polysaccharide C), the ratio of A) to B) plus C) ranging from about 400:1 to about 1:1000, respectively.

Paper made by the process described above also constitutes part of the present invention.

The following examples are set forth for purposes of illustration only and are not be construed as limitations on the present invention except as set forth in the appended claims. All parts and percentages are by weight unless otherwise specificed.

In the examples which follow, the ionic organic polymer microbead and/or the high molecular weight, ionic polymer and/or ionic starch are added sequentially directly to the stock or just before the stock reaches the headbox.

Unless otherwise specified, a 70/30 hardwood/softwood bleached kraft pulp containing 25% $CaCO_3$ is used as furnish at a pH of 8.0. Retention is measured in a Britt Dynamic Drainage Jar. First Pass Retention (FPR) is calculated as follows:

$$FPR = \frac{\text{Headbox Consistency} - \text{Tray Water Consistency}}{\text{Head Box Consistency}}$$

First Pass Retention is a measure of the percent of solids that are retained in the paper. Drainage is a measure of the time required for a certain volume of water to drain through the paper and is here measured as a 10×drainage. (K. Britt, TAPPI 63(4) p67 (1980). Hand sheets are prepared on a Noble and Wood sheet machine.

In all the examples, the ionic polymer and the microbead are added separately to the thin stock and subjected to shear. Except when noted, the charged microbead (or silica or bentonite) is added last. Unless noted, the first of the additives is added to the test furnish in a "Vaned Britt Jar" and subjected to 800 rpm stirring for 30 seconds. Any other additive is then added and also subjected to 800 rpm stirring for 30 seconds. The respective measurements are then carried out.

Doses are given on pounds/ton for furnish solids such as pulp, fillers etc. Polymers are given on a real basis, silica as $SiO_2$ and starch, clay and bentonite are given on an as is basis.

I. Cationic polymers used in the examples are:

Cationic Starch: Potato starch treated with 3-chloro-2-hydroxypropyltrimethylammonium chloride to give a 0.04 degree of substitution.

10 AETMAC/90 AMD: A linear cationic copolymer of 10 mole % of acryloxyethyltrimethylammonium chloride and 90 mole % of acrylamide of 5,000,000 to 10,000,000 mol. wt. with a charge density of 1.2 meg./g.

5 AETMAC/95 AMD: A linear copolymer of 5 mole % of acryloxyethltrimethylammonium chloride and 90 mole % of acrylamide of 5,000,000 to 10,000,000 mol. wt.

55 AETMAC/45 AMD: A linear copolymer of 55 mole % of acryloxyethyltrimethylammonium chloride and 45 mole % of acrylamide of 5,000,000 to 10,000,000 mol. wt. and a charge density of 3.97 meg./g.

40 AETMAC/60 AMD: A linear copolymer of 40 mole % of acryloxyethyltrimethylammonium chloride and 60 mole % of acrylamide of 5,000,000 to 10,000,000 mol. mt.

50 EPI/47 DMA 3 EDA: A copolymer of 50 mole % of epichlorohydrin, 47 mole % of dimethylamine and 3.0 mole % of ethylene diamine of 250,000 mol. wt II. Anionic Polymers used in the examples are:

30 AA/70 AMD: A linear copolymer of 30 mole % ammonium acrylate and 70 mole % of acrylamide of 15,000,000 to 20,000,000 mol. wt.

7AA/93 AMD A linear copolymer of 7 mole % ammonium acrylate and 93 mole % of acrylamide of 15,000,000 to 20,000,000 mol. wt.

10 APS/90 AMD: A linear copolymer of 10 mole % of sodium 2-acrylamido-2-methylpropanesulfonate and 90 mole % of acrylamide of 15,000,000 to 20,000,000 mol. wt.

III. Anionic particles used in the examples are:

SILICA: Colloidal silica with an average size of 5 nm, stabilized with alkali and commercially available.

BENTONITE: Commercially available anionic swelling bentonite from clays such as sepiolite, attapulgite or montmorillonite as described in U.S. Pat. No. 4,305,781.

IV. Latices used in the examples are:

| Latex | Particle Size in nm | Anionic Charge Density $Å^2$/Charge Group |
|---|---|---|
| Polystyrene | 98 | $1.4 \times 10^3$ |
| Polystyrene | 30 | $1.1 \times 10^3$ |
| Polystyrene | 22 | $0.36 \times 10^3$ |

V. Microbeads used in the examples are:

30 AA/70 AMD/50 ppm MBA: An inverse emulsion copolymer of 30 mole % of sodium acrylate and 70 mole % of acrylamide crosslinked with 50 ppm of methylenebisacrylamide with a particle diameter of 1,000–2,000*nm; SV-1.64 mPa.s.

40 AA/60 MBA: A microbead dispersion of a copolymer of 40 mole % of ammonium acrylate and 60 mole % of N,N'-methylenebisacrylamide (MBA) with a particle diameter of 220*nm.

30 AA/70 AMD/349 pom MBA: A microemulsion copolymer of 30 mole % of sodium acrylate and 70 mole % of acrylamide crosslinked with 349 ppm of N,N'-methylenebisacrylanide (MBA) of 130*nm particle diameter, SV-1.17 to 1.19 mPa.s 30 AA/70 AMD/749 ppm MBA: A microemulsion copolymer of 30 mole % of sodium acrylate and 70 mole % of acrylamide crosslinked with 749 ppm of N,N'-methylenebisacrylamide (MBA), Sv-1.06 mPa.s.

60 AA/40 AMD/1,381 ppm MBA: A microemulsion copolymer of 60 mole % of sodium acrylate and 40 mole % of acrylamide crosslinked with 1,381 ppm of N,N'-methylene-bis acrylamide (MBA) of 120*nm particle diameter; SV-1.10 mPa.s.

30 APS/70 AMD/995 ppm MBA: A microemulsion copolymer of 30 mole % of sodium 2-acrylamido-2-methylpropane sulfonate and 70 mole % of acrylamide crosslinked with 995 ppm of methylenebisacrylamide (MBA); SV-1.37 mPa.s.

30 AA/70 AMD/1000 ppm MBA/ 2% SURFACTANT (TOTAL EMULSION): A microemulsion copolymer of 30 mole % of sodium acrylate and 70 mole % of acrylamide crosslinked with 1,000 ppm of N,N'-methylenebisacrylamide with 2% diethanolamide oleate and 464*nm particle diameter.

30 AA/70 AMD/1,000 ppm MBA/ 4% SURFACTANT (TOTAL EMULSION): A microemulsion copolymer of 30 mole % of sodium acrylate and 70 mole % of acrylamide crosslinked with 1,000 ppm of N,N'-methylenebisacrylamide with 4% diethanolamide oleate and of 149*nm particle diameter, SV-1.02 mPa.s 30 AA/70 AMD/ 1,000 ppm MBA/ 8% SURFACTANT(TOTAL EMULSION): A Microemulsion copolymer of 30 mole % of sodium acrylate and 70 mole % of acrylamide crosslinked with 1000 ppm of N,N'-methylenebisacrylamide with 8% diethanolamide oleate and of 106*nm particle diameter, SV-1.06 mPa.s.

Procedure for the Preparation of Anionic Microemulsions

30 AA/70 AMD/349 ppm MBA - 130 nm

An aqueous phase is prepared by sequentially mixing 147 parts of acrylic acid, 200 parts deionized water, 144 parts of 56.5% sodium hydroxide, 343.2 parts of acrylamide crystal, 0.3 part of 10% pentasodium diethylenetriaminepentaacetate, an additional 39.0 parts of deionized water, and 1.5 parts of 0.52% copper sulfate pentahydrate. To 110 parts of the resultant aqueous phase solution, 6.5 parts of deionized water, 0.25 part of 1% t-butyl hydroperoxide and 3.50 parts of 0.61% methylene bisacrylamide are added. 120 Parts of the aqueous phase are then mixed with an oil phase containing 77.8 parts of low odor paraffin oil, 3.6 parts of sorbitan sesquioleate and 21.4 parts of polyoxyethylene sorbitol hexaoleate.

This resultant clear, microemulsion is deaerated with nitrogen for 20 minutes. Polymerization is initiated with gaseous $SO_2$, allowed to exotherm to 40° C. and controlled at 40° C. (+5° C.) with ice water. The

* The unswollen number average particle diameter in nanometers is defined and used herein as that determined by the quasi-elastic light scattering spectroscopy (QELS) as carried out on the polymer emulsion, microemulsion or dispersion. ice water is removed when cooling is no longer required. The nitrogen is continued for one hour. The total polymerization time is 2.5 hours.

For purposes of use in the instant process, the polymer may be recovered from the emulsion by stripping or by adding the emulsion to a solvent which precipitates the polymer, e.g. isopropanol, filtering off the resultant solids, and redispersing in water for use in the papermaking process. The precipitated polymer microbeads may be dried before redispersion in water.

Alternatively, the microemulsion per se may also be directly dispersed in water. Depending on the surfactant and levels used in the microemulsion, dispersion in water may require using a high hydrophilic lipopilic balance (HLB) inverting surfactant such as ethoxylated alcohols; polyoxyethlated sorbitol hexaoleate; diethanolamine oleate; ethoxylated laurel sulfate et. as in known in the art.

The concentration of the microbeads in the above-described redispersion procedures is similar to that used with other thin stock additives, the initial dispersion being at least 0.1%, by weight. The dispersion may be rediluted 5–10 fold just before addition to the papermaking process.

Preparation of Cationic Organic Microbead 40 AETMAC/60 AMD/100 ppm

MBA—100 nm By microemulsion Polymerization

An aqueous phase containing 21.3 parts, by weight of acrylamide, 51.7 parts of a 75% acryloxyethyltrimethyl ammonium chloride solution, 0.07 part of 10% diethylenetriamine pentaacetate (penta sodium salt), 0.7 part of 1% t-butyl hydroperoxide and 0.06 part of methylenebisacrylamide dissolved in 65.7 parts of deionized water is prepared. The pH is adjusted to 3.5 (±0.1). An oil phase composed of 8.4 parts of sorbitan sesquioleate, 51.6 parts of polyoxyethylene sorbitol hexaoleate dissolved in 170 parts of a low odor paraffin oil is prepared. The aqueous and oil phase are mixed together in an air tight polymerization reactor fitted with a nitrogen sparge tube, thermometer and activator addition tube. The resultant clear microemulsion is sparged with nitrogen for 30 minutes and the temperature is adjusted to 27.5° C. Gaseous sulfur dioxide activator is then added by bubbling nitrogen through a solution of sodium metabisulfite. The polymerization is allowed to exotherm to its maximum temperature (about 520° C.) and then cooled to 25° C.

The particle diameter of the resultant polymer microbead is found to be 100 nm. The unswollen number average particle diameter in nanometers (nm) is determined by quasi-elastic light scattering spectroscopy (QELS). The SV is 1.72 mPa.s.

Preparation of Cationic Organic Inverse Emulsion 40 AETMAC/60 AMD/100 ppm MBA 1,000 nm by Inverse Emulsion Polymerization An aqueous phase is made by dissolving 87.0 parts of commercial, crystal acrylamide (AMD), 210.7 parts of a 75% acryloxyethyltrimethylammonium chloride (AETMAC) solution, 4.1 parts of ammonium sulfate, 4.9 parts of a 5% ethylene diaminetetraacetic acid (disodium salt) solution, 0.245 part (1000 wppm) of methylenebisacrylamide (MBA) and 2.56 parts of t-butyl hydroperoxide into 189 parts of deionized water. The pH is adjusted to 3.5 (±0.1) with sulfuric acid.

The oil phase is made by dissolving 12.0 gms of sorbitan monooleate into 173 parts of a low odor paraffin oil.

The aqueous phase and oil phase are mixed together and homogenized until the particle size is in the 1.0 micron range.

The emulsion is then transferred to a one liter, three-necked, creased flask equipped with an agitator, nitrogen sparge tube, sodium metabisulfite activator feed line and a thermometer.

The emulsion is agitated, sparged with nitrogen and the temperature adjusted to 25° C. After the emulsion is sparged 30 minutes, 0.8% sodium metabisulfite (MBS) activator solution is added at a 0.028 ml/minute rate. The polymerization is allowed to exotherm and the temperature is controlled with ice water. When cooling is no longer needed, the 0.8% MBS activator solution-/addition rate is increased and a heating mantle is used to maintain the temperature. The total polymerization time takes approximately 4 to 5 hours using 11 mls of MBS activator. The finished emulsion product is then cooled to 25° C.

The particle diameter is found to be 1,000 nm. The unswollen number average particle diameter in nanometers is determined by the quasi-elastic light scattering spectroscopy (QELS). The SV is 1.24 mPa.s.

EXAMPLE 1

Using the paper-making procedure described above, the drainage times are measured on 1) alkaline stock containing 5% $CaCO_3$, alone, 2) the same stock with added linear, high molecular weight cationic copolymer of 10 mole % acryloxyethyltrimethylammonium chloride and 90 mole % of acrylamide (10 AETMAC/90 AMD) and 3) the same stock with added cationic copolymer and anionic microbead made from 30 mole % acrylic acid 70 mole % of acrylamide (30 AA/70 AMD) and cross-linked with 349 ppm of methylenebisacrylamide (MBA) of 130 nm particle diameter and added as a redispersed 0.02% aqueous solution. The results are shown in Table I, below.

TABLE I

| Cationic Polymer lbs/Ton | Anionic Microbead lbs/Ton | Drainage in Seconds |
|---|---|---|
| -0- | -0- | 88.4 |
| -2- | -0- | 62.3 |
| -2- | 0.5 | 37.5 |

The addition of cationic polymer reduces drainage time from 88.4 to 62.3 seconds. Surprisingly microbeads reduce the drainage times by another 24.8 seconds to 37.5 seconds, a 39.8% reduction which is a significant improvement in drainage times.

EXAMPLE 2

The alkaline furnish used in this example contains 5.0 lbs/ton of cationic starch. To this furnish is added to following additives as described in Example 1. Drainage times are then measured and reported in Table II, below.

TABLE III

| Cationic Polymer lbs/Ton | Anionic Microbead lbs/Ton | Drainage in Seconds |
|---|---|---|
| -0- | -0- | 121.9 |
| 1 - 10 AETMAC/90 AMD | -0- | 89.6 |
| 1 - 10 AETMAC/90 AMD | 0.5 - 30 AA/70 AMD/ 349 ppm - 130 nm | 57.8 |

In the presence of a mixture of high molecular weight cationic polymer and, cationic starch, anionic polymer microbeads greatly improves drainage.

EXAMPLE 3

Following the procedure of Example 1, various other comparative runs are made using a second alkaline stock containing 10 lbs/ton of cationic starch, and bentonite, as disclosed in U.S. Pat. No. 4,753,710, in order to show the benefits of the use of organic microbeads in accordance with the invention hereof. The results are shown in Table III, below.

TABLE III

| Cationic Polymer lbs/Ton | Anionic Micro-Particle (lbs./Ton) | Drainage in Seconds |
|---|---|---|
| -0- | -0- | 132.3 |
| 1.0 - 10 AETMAC/ 90 AMD | 5.0 - Bentonite | 53.1 |
| 1.0 - 10 AETMAC/ 90 AMD | 0.5 - 30 AA/70 AMD/ 349 ppm MBA - 130 nm | 55.1 |
| 1.0 - 10 AETMAC/ 90 AMD | 0.5 - 100 AA-1985 ppm MBA-80 nm | 65.1 |
| 1.0 - 55 AETMAC/ 45 AMD | 5.0 - Bentonite | 76.4 |
| 1.0 - 55 AETMAC/ 45 AMD | 0.5 - 30 AA/70 AMD/ 349 ppm MBA - 130 nm | 55.4 |
| 1.0 - 55 AETMAC/ 45 AMD | 0.5 - 60 AA/40 AMD/ 1,381 ppm MBA - 120 nm | 45.7 |
| 1.0 - 55 AETMAC/ 45 AMD | 0.5 - 100 AA-1985 ppm MBA | 48.6 |

When the 10% cationic polymer AETMAC/AMD (10/90) is used in conjunction with 5.0 lbs. of bentonite, similar drainage results to those obtained using only 0.5 lb. of 30% anionic microbead AA/AMD (30/70) in place of the bentonite, are obtained. With a cationicity polymer, bentonite gives a slower drainage rate of 76.4 seconds and the 30% anionic microbead about the same drainage rate of 55.4 seconds. With the higher cationicity polymer (55%) and 0.5 lbs/ton of a high anionicity microbead, AA/AMD (60/40) a far superior drainage time of 45.7 seconds is obtained, using far less additive.

EXAMPLE 4

An alkaline paper stock containing 10 pounds/ton of cationic starch is treated as described in Example 1. The results are shown in Table IV, below.

TABLE IV

| Cationic Polymer lbs/Ton | Anionic Micro-particle lbs/Ton | Drainage in Seconds |
|---|---|---|
| -0- | -0- | 115.8 |
| 0.5 - 10 AETMAC/90 AMD | -0- | 83.5 |
| 0.5 - 10 AETMAC/90 AMD | 5.0 - Bentonite | 51.1 |
| 0.5 - 10 AETMAC/90 AMD | 0.5 - 30 AA/70 AMD/ 349 ppm MBA - 130 nm | 57.3 |
| 0.5 - 55 AETMAC/45 AMD | 0.5 - 60 AA/40 AMD/ 1,381 ppm - 120 nm | 46.1 |
| 1.0 - 10 AETMAC/90 AMD | 5.0 - Bentonite | 42 |
| 1.0 - 55 AETMAC/45 AMD | 0.5 - 60 AA/40 AMD/ 1,381 ppm BMA - 120 nm | 38.9 |

The combination of 0.5 lb/ton of cationic polymer and 5.0 lbs/ton of bentonite gives a good drainage of 51.5 seconds, somewhat better than the 0.5 lb of 30% anionicity microbeads, i.e. 57.3 seconds. However, bentonite is inferior to the results achieved using 0.5 lb/ton of a higher (60%) anionicity polymer, i.e. of 46.1 seconds. Increasing the amount of cationic polymer to 1.0 lb/ton results in improved bentonite and 60% anionic polymer microbead times of 42 and 38.9 seconds, however, the microbead results are again superior.

EXAMPLE 5

The procedure of Example 1 is again followed except that first pass retention values are measured. The organic anionic microbead is compared at a 0.5 lbs/ton rate to 2.0 lbs/ton of silica and 5.0 lbs/ton of bentonite in an alkaline paper stock as known in the art. The organic, 30% anionic polymer microbeads give the best retention values at a lower concentration, as shown in Table V, below.

TABLE V

| Cationic Polymer lbs/Ton | Anionic Micro-bead lbs/Ton | Fines First Pass Retention in % |
|---|---|---|
| 2.0 - 10 AETMAC/90 AMD | -0- | 50.3 |
| 2.0 - 10 AETAMC/90 AMD | 2.0 - Silica- 5 nm | 55.3 |

TABLE V-continued

| Cationic Polymer lbs/Ton | Anionic Micro-bead lbs/Ton | Fines First Pass Reten-tion in % |
|---|---|---|
| 2.0 - 10 AETMAC/90 AMD | 5.0 - Bentonite | 55.8 |
| 2.0 - 10 AETMAC/90 AMD | 0.5 - 30 AA/70 AMD/ 749 ppm MBA | 59.2 |

EXAMPLE 6

The procedure of Example 1 is again followed except that alum is added to the stock immediately before the cationic polymer. The test furnish is alkaline stock containing 5.0 lbs/ton of cationic starch and 25% $CaCO_3$. The results are set forth below in Table VI.

TABLE VI

| Cationic Polymer lbs/Ton | Anionic Micro-bead lbs/Ton | Drainage in Seconds |
|---|---|---|
| | 5 lbs/ton Alum | |
| 0.5 - 10 AETMAC/90 AMD | 5 - Bentonite | 46.1 |
| 0.5 - 10 AETMAC/90 AMD | 0.5 - 30 AMD/ 349 ppm MBA -130 nm | 39.9 |
| | 10 lbs/ton Alum | |
| 1 - 10 AETMAC/90 AMD | 5 - Bentonite | 33.5 |
| 1 - 10 AETMAC/90 AMD | 0.5 - 30 AA/70 AMD/ 349 ppm - 130 nm | 29.6 |

The alum-treated furnish which is contracted with the polymer microbead has a faster drainage rate than that treated with 10 times as much bentonite. In a comparative test using 0.5 lb of 10 AETMAC/90 AMD and 5.0 lbs bentonite without alum, an equivalent drainage time of 46.1 seconds, is achieved.

EXAMPLE 7

This example demonstrates the greater efficiency of the anionic organic polymer microbeads of the present invention used with alum as compared to bentonite alone. This efficiency is not only attained using a significantly lower anionic microbead dose but, also enable the use of a lower amount of cationic polymer. The furnish is alkaline and contains 5.0 lbs/ton of cationic starch. The procedure of Example 1 is again used The results are shown in Table VII, below.

TABLE VII

| Cationic Polymer lbs/Ton | Alum* lbs/ton | Anionic Microbead lbs/ton | Drainage in Seconds |
|---|---|---|---|
| 0 | 0 | 0 | 103.4 |
| 0.5-10 AETMAC/90 AMD | 0 | 0 | 87.5 |
| 0.5-10 AETMAC/90 AMD | 5 | 0 | 76.4 |
| 0.5-10 AETMAC/90 AMD | 5 | 0.25-30 AA/ 70 AMD/ 349 ppm MBA-130 nm | 51.1 |
| 0.5-10 AETMAC/90 AMD | 5 | 0.50-30 AA/ 70 AMD/ 349 ppm MBA-13 nm | 40.6 |
| 0.5-10 AETMAC/90 AMD | 0 | 5-Bentonite | 51.6 |
| 1.0-10 AETMAC/90 AMD | 0 | 5-Bentonite | 40.2 |

*Alum is added immediately before the cationic polymer.

Thus, at a 0.5 lb. cationic polymer addition level, the anionic organic microbeads used with alum are approximately 20 fold more efficient than bentonite used alone (0.25 lb. vs. 5.0 lbs.). The cationic polymer level can be reduced in half (0.50 lb. vs. 1.0 lb.) compared to bentonite when the microbead level is raised to 0.50 lb., which is 10 fold lower than the bentonite dose.

EXAMPLE 8

The procedure of Example 7 is again followed except that polyaluminum chloride is used in place of alum. As can be seen, in Table VIII, equivalent results are achieved.

TABLE VIII

| Cationic Polymer lbs/Ton | Aluminum Salt lbs/Ton | Anionic Micro bead lbs/Ton | Drainage In Seconds |
|---|---|---|---|
| 0.5-10 AETMAC/ 90 AMD | 0 | Bentonite | 57.5 |
| 0.5-10 AETMAC/ 90 AMD | 5-Alum | 0.5-30 AA/ 70 AMD/349 ppm-130 nm | 41.5 |
| 0.5-10 AETMAC/ 90 AMD | 8.5 Poly-aluminum Chloride (5.0 lbs alum (equivalent) | 0.5-30 AA/ 70 AMD/349 ppm-130 nm | 42.0 |

EXAMPLE 9

To a batch of alkaline paper stock is added cationic starch. The drainage time is measured after addition of the following additives set forth in Table IX, below. The procedure of Example 1 is again used.

TABLE IX

| Cationic Polymer lbs/Ton | Anionic Microbead lbs/Ton | Drainage (Sec.) 5.0 lbs/Ton Starch | Drainage (Sec.) 10 lbs/Ton Starch |
|---|---|---|---|
| 0.5-10 AETMAC/ 90 AMD | 5-Bentonite | 46.9 | 50.9 |
| 0.5-10 AETMAC/ 90 AMD plus 5 lbs Alum | 0.5-30 AA/ 70 AMD/349 ppm MBA-130 nm | 34.0 | 32.7 |

C = Comparative Test

The alum/polymer microbead combination gives better drainage rates than the polymer/bentonite combination without alum.

EXAMPLE 10

First pass retention is measured on an alkaline furnish containing 5.0 lbs/ton of starch to which the additives of Table X, below, are added.

TABLE X

| Microbead lbs/Ton | Fines First Pass Retention 10 AETMAC/90 AMD (lbs/Ton) 0.5 | 1.0 | 2.0 |
|---|---|---|---|
| 5.0 - Bentonite | 39.9% | 41.6% | 46.8% |
| *5.0 - 30 AA/70 AMD/349 ppm MBA -130 nm | 39.9% | 44.4% | 48.5% |

*With the anionic polymer microbead 5.0 lbs./ton of alum is added with the cationic polymer.

The microbead and bentonite give similar retentions with 0.5 lb/ton of cationic polymer but with higher concentrations of polymer better retention is obtained with the microbeads.

EXAMPLE 11

Another alkaline paper furnish containing 5 lbs/ton of cationic starch and 2.5 lbs/ton of alum to which the additives of Table XI are added as in Example 10, is treated.

TABLE XI

| Anionic Microbead lbs/Ton | Fines First Pass Retention 10 AETMAC/90 AMD (lbs/Ton) 0.5 | 1.0 |
|---|---|---|
| 5 - Bentonite | 34.6% | 42.3% |
| 7 - Bentonite | — | 43.1% |
| 0.25 - 30 AA/70 AMD/ 349 ppm MBA - 130 nm | 35.7% | 43.4% |
| 0.5 - 30 AA/70 AMD/ 349 ppm MBA - 130 nm | 38.7% | 44.6% |

A significant reduction in the dosages of polymeric microbead results in equivalent or superior retention properties.

EXAMPLE 12

Lower molecular weight, cationic, non-acrylamide based polymers are used in papermaking and in this example the effect of anionic microbeads on the performance of a polyamine of said class is set forth. To an alkaline furnish containing 5 lbs/ton of cationic, starch is added 1.0 lb/ton of a cationic polymeric polymer of 50 mole % epichlorohydrin, 47 mole % dimethylamine and 3.0 mole % ethylenediamine of 250,000 mol. wt. The polyamine is used alone and in combination with 0.5 lbs/ton of microbead copolymer of 60% acrylic acid and 40% acrylamide cross linked with 1,381 ppm of methylenebisacrylamide and having 120 nm diameter particle size. From the data of Table XII it is seen that addition of the highly effective organic microbead cuts drainage time in half from 128.1 to 64.2 seconds.

TABLE XII

| Cationic Polymer lbs/Ton | Anionic Microbead lbs/Ton | Drainage In Seconds |
|---|---|---|
| -0- | -0- | 138.8 |
| -1- | -0- | 128.1 |
| -1- | 0.5 | 64.2 |

EXAMPLE 13

In order to evaluate the use of microbeads on mill stock, a test is run on stock from a commercial paper mill The paper stock consists of 40% hardwood/30% soft wood/30% broke containing 12% calcium carbonate, 4% clay, and 2.5 lbs/ton of alkyl succinic anhydride (ASA) synthetic size emulsified with 10 lbs/ton cationic potato starch. An additional 6 lbs/ton of cationic potato starch and 6 lbs/ton of alum are also added to this stock. The additives listed in Table XIII, below, are added and drainage times are measured, as in Example 1.

TABLE XIII

| Cationic Polymer lbs/Ton | Anionic Microbead lbs/Ton | Drainage In Seconds |
|---|---|---|
| -0- | -0- | 153.7 |
| 0.5 - 10 AETMAC/90 AMD | -0- | 112.8 |
| 0.5 - 10 AETMAC/90 AMD | 5.0 - Bentonite | 80.3 |
| 0.5 - 10 AETMAC/90 AMD | 0.25 - 30 AA/ 70 AMD -349 ppm MBA - 130 nm | 69.6 |
| 0.5 - 10 AETMAC/90 AMD | 0.5 - 30 AA/ 70 AMD - 349 ppm MBA - 130 nm | 57.5 |
| 1.0 - 10 AETMAC/90 AMD | 5.0 - Bentonite | 71.9 |
| 1.0 - 10 AETMAC/90 AMD | 0.5 - 30 AA/ 70 AMD - 349 ppm MBA - 130 nm | 49.1 |

The paper stock from the above run has a 153.7 second drainage time Significant reduction of drainage time to 80.3 seconds is achieved with 0.5 lb/ton of high molecular weight, cationic polymer and 5 lbs/ton of bentonite. Replacement of the bentonite with a mere 0.25 lb/ton of organic anionic microbeads reduces drainage time another 10.7 seconds to 69.9 seconds. Thus, the microbeads at 1/20 the concentration give a superior drainage time to bentonite. The use of 0.5 lb/ton of the microbeads reduces the drainage time to 57.5 seconds. This is 22.8 seconds faster than ten times the weight of bentonite.

When testing is carried out using 1.0 lb/ton of cationic polymer and 5.0 lbs/ton of bentonite, drainage time is 71.9 seconds. However, when the test is performed with 0.5 lb of microbeads, the drainage time is 49.1 seconds which is 22.8 seconds faster than bentonite with one tenth the amount of microbead.

EXAMPLE 14

The effect of using a cationic polymer of a lower charge density is investigated on the paper stock that was used in proceeding Example 13 and shown in Table XIV. The cationic polymer used, 5 AETMAC/95 AMD, has one half the charge density as that of 10 AETMAC/90 AMD that was used in Example 13. All else remains the same.

TABLE XIV

| Cationic Polymer lbs/Ton | Additional Alum* lbs/Ton | Microbead lbs/Ton | Drainage In Seconds |
|---|---|---|---|
| 0.5-5 AETMAC/ 95 AMD | 0 | 0 | 94.7 |
| 0.5-5 AETMAC/ 95 AMD | 0 | 5-Bentonite | 51.4 |
| 0.5-5 AETMAC/ 95 AMD | 2.5 | 5-Bentonite | 56.7 |
| 0.5-5 AETMAC/ 95 AMD | 0 | 0.5-30 AA/70 AMD/349 ppm MBA-130 nm | 48.7 |
| 0.5-5 AETMAC/ 95 AMD | 2.5 | 0.5-30 AA/70 AMD/349 ppm MBA-130 nm | 39.5 |

*Alum is added immediately before the cationic polymer.

The superiority of 1/10th the amount of polymeric microbead to bentonite is evident with a lower charge cationic polymer also. Furthermore, the drainage time of cationic polymer and bentonite did not improve but decreased by 5.3 sec. on further addition of 2.5 lbs/ton of alum.

EXAMPLE 15

The effect of changing the amount of starch on drainage time is measured by not incorporating the 6.0 lbs/ton of additional starch added to the furnish in Example 13 using the same stock. The results are shown in Table XV.

TABLE XV

| Cationic Polymer lbs/Ton | Additional Alum* lbs/Ton | Microbead lbs/Ton | Drainage In Seconds |
|---|---|---|---|
| 0.5-5 AETMAC/ 95 AMD | 0 | 5 Bentonite | 45.9 |
| 0.5-5 AETMAC 95 AMD | 0 | 0.5-30 AA/70 AMD/349 ppm MBA-130 nm | 39.5 |
| 0.5-5 AETMAC/ 95 AMD | −2.5 | 0.5-30 AA/70 AMD/349 ppm | 29.5 |

TABLE XV-continued

| Cationic Polymer lbs/Ton | Additional Alum* lbs/Ton | Microbead lbs/Ton | Drainage In Seconds |
|---|---|---|---|
| | | MBA-130 nm | |

*Alum is added immediately before the cationic polymer.

EXAMPLE 16

To evaluate the effect of the charge density of the cationic polymer on retention, to the furnish of Example 13, are added the additives shown in Table XVI. First pass retention values are measured, as in Example 5.

TABLE XVI

| Alum* lbs/Ton | Microbead lbs/Ton | 10 AETMAC/ 90 AMD | 5 AETMAC/ 95 AMD |
|---|---|---|---|
| | | 0.5 lbs/Ton % Retention | 0.5 lbs/Ton % Retention |
| 0 | 0 | 36% | 30.9% |
| 0 | 5-Bentonite | 32.4% | 39.6% |
| 2.5 | 0.5-30 AA/ 70 AMD/349 ppm MBA-130 nm | 45.1% | 49.1% |
| | | at 1.0 lbs/Ton % Retention | at 1.0 lbs/Ton % Retention |
| 0 | 5-Bentonite | 45.1 | 42.5 |
| 2.5 | 0.5-30 AA/ 70 AMD/349 ppm MBA-130 nm | 51.3 | 57.1 |

*Alum is added immediately before the cationic polymer.

Polymer microbeads are shown to be effective when used with high molecular weight, cationic polymers of lower charge density.

EXAMPLE 17

A stock is taken from a second commercial mill. It is a goal of this example to demonstrate that microbeads-/alum give equivalent drainage times to those of current commercial systems. The mill stock consists of 45% deinked secondary fiber/25% softwood/30% broke containing 15% calcium carbonate and 3.0 lbs/ton of alkyl ketene dimer synthetic size emulsified with 10 lbs/ton of cationic starch. A second portion of 10 lbs of cationic starch is added to the thick stock and the ingredients listed in Table XVII, below are added to the furnish, as described in Example 1.

TABLE XVII

| Cationic Polymer lbs/Ton | Alum* lbs/Ton | Anionic Microbead lbs/Ton | Drainage In Seconds |
|---|---|---|---|
| 0.6 10 AETMAC/ 90 AMD | 0 | 5-Bentonite' | 158.2 sec. |
| 0.6 10 AETMAC/ 90 AMD | −5.0 | 0.5-30 AA/70 AMD/ 349 ppm MBA-130 nm | 141.6 sec. |

*Alum is added immediately before the cationic polymer.

The microbeads/alum gives a faster drainage rate than the commercial bentonite system used in the mills routine production of paper. Other experimental runs result in lesser conclusive effectiveness with this pulp.

EXAMPLE 18

Microbead retention efficiency is evaluated on papers made using a pilot Fourdrinier papermaking machine. The paper stock consists of pulp made from 70% hardwood and 30% softwood containing 25% calcium carbonate and 5 lbs/ton of cationic starch. The additives in the Table XVIII, below, are placed into the furnish in successive runs and first pass retention percentages are measured. A 46 lb base weight paper is made.

The cationic, high molecular weight polymer is added just before the fan pump, the anionic microbead is added just before the pressure screen and alum, when added, is added just before the cationic polymer. Results are set forth in Table XVIII, below

TABLE XVIII

| Cationic Polymer lbs/Ton | Alum lbs/Ton | Anionic Microbead lbs/Ton | Ash-First Retention % |
|---|---|---|---|
| 0 | 0 | 0 | 34.4% |
| 0.6-10 AETMAC/ 90 AMD | 0 | 7.0-Bentonite | 61.3% |
| 0.6-10 AETMAC/ 90 AMD | 2.5 | 0.25-30 AA/70 AMD/ 349 ppm MBA-150 nm SV-1.32 | 62.7% |
| 0.6-10 AETMAC/ 90 AMD | 2.5 | 0.50-30 AA/70 AMD/ 349 ppm MBA-150 nm SV-1.32 | 67.0% |

In this example, the combination of 0.5 lb/ton of microbeads and 2.5 lbs/ton of alum results in a 5.7% superior retention over 7.0 lbs/ton of bentonite alone. The 7.0 lbs/ton of bentonite is about equal to the combination of 0.25 lbs of beads and 2.5 lbs/ton of alum in retention properties, a significant dosage reduction.

EXAMPLE 19

The same pilot paper machine and paper stock that was used in Example 18 is again used except that a 55 lb "basis weight" paper is made. Additives in Table XIX, below, are mixed into the furnish as in the preceding example on successive runs and retention values are measured.

TABLE XIX

| Cationic Polymer lbs/Ton | Alum lbs/Ton | Anionic Microbead lbs/Ton | Ash-First Pass Retention % |
|---|---|---|---|
| 0 | 0 | 0 | 39.3% |
| 0.6-10 AETMAC/ 90 AMD | 0 | 0 | 39.4% |
| 0.6-10 AETMAC/ 90 AMD | 0 | 7.0 Bentonite | 74.6% |
| 0.6-10 AETMAC/ 90 AMD | 2.5 | 0.5-30 AA/70 AMD/ 349 ppm MBA-150 nm SV-1.32 | 74.5% |
| 0.6-10 AETMAC/ 90 AMD | 5.0 | 0.5-30 AA/70 AMD/ 349 ppm MBA-150 nm SV-1.32 | 74.7% |

In comparing the heavier (55 lb) basis weight paper of Example 19 to that of Example 18 (46 lb), under all conditions, the heavier paper has better retention. With the heavier paper there is no significant difference in retention between the paper prepared with bentonite alone and that prepared with microbeads and either 2.5 lbs or 5 lbs of alum, except the significant dosage reduction i.e. 71bs. vs. 0.5 lb.

EXAMPLE 20

The effect of microbead on paper formation is evaluated by treatment of an alkaline furnish containing 5.0 lbs/ton of starch with the additives listed in Table XX, below, as described in Example 18.

TABLE XX

| Cationic Polymer lbs/Ton | Alum lbs/Ton | Anionic Microbead lbs/Ton | Paprican* Microscanner SP/RMS Ratio |
|---|---|---|---|
| 1-10 AETMAC/ 90 AMD | 0 | 5-Bentonite | 66 |
| 1-10 AETMAC/ 90 AMD | 0 | 1-30 AA/70 AMD/349 ppm MBA-130 nm | 69 |

*Paper formation is measured on hand sheets in the Paprican micro-scanner as described by R. H. Trepanier, Tappi Journal, December pg. 153, 1989. The results indicate that the microbead treated paper has better formation at a lower dosage than the bentonite treated paper as the larger number signifies better formation.

EXAMPLE 21

Using the paper stock of Example 20, except that the cationic starch concentration is increased to lbs/ton, formation is measured on paper made with the additives set forth in Table XXI.

TABLE XXI

| Cationic Polymer lbs/Ton | Anionic Microbead lbs/Ton | Paprican Micro-scanner SP/RMS Ratio | Drainage Sec. |
|---|---|---|---|
| 1-10 AETMAC/90 AMD | 5-Bentonite | 73 | 42 |
| 1-55 AETMAC/45 AMD | 0.5-60 AA/40 AMD/ 1,381 ppm MBA | 81 | 38.9 |
| 1-55 AETMAC/45 AMD | 1.0-60 AA/40 AMD/ 1,381 ppm MBA | 77 | 33.5 |

Microbeads give superior hand sheet paper formation and better drainage times compared to bentonite, and at a lower dosage.

EXAMPLE 22

To an alkaline furnish containing 5-lbs of cationic starch, the ingredients set forth in Table XXII are added to the furnish of Example 21 and formation is observed visually on the paper hand sheets, produced thereby.

TABLE XXII

| Cationic Polymer lbs/Ton | Alum* lbs/Ton | Anionic Microbead lbs/Ton | Visual Formation | Drainage Sec. |
|---|---|---|---|---|
| 0.5-10 AETMAC/90 AMD | -0- | -0- | A | 87.8 |
| 0.5-10 AETMAC/90 AMD | -0- | 5-Bentonite | A | 57.5 |
| 0.5-10 AETMAC/90 AMD | 2.5 | 0.5-30 AA/70 AMD/ 349 ppm MBA -130 nm | A | 47.8 |
| 1.0-10 AETMAC/90 AMD | -0- | 5.0-Bentonite | B | 49.2 |
| 1.0-10 AETMAC/90 AMD | 2.5 | 0.5-30 AA/70 AMD/ 349 ppm MBA-130 nm | B | 39.8 |

*Alum is added immediately before the cationic polymer.

Hand sheets from the first three samples have equivalent formation (A) by visual observation. The last two samples (B) themselves have equivalent formation by visual observation but their formation is not as good as the first three sheets. The experiment shows the superior drainage times are achieved with a microbead alum combination with equivalent visual paper formation as compared to bentonite, above, at higher dosage.

EXAMPLE 23

In order to evaluate a different type of anionic microparticle, three different particle sizes of hydrophobic polystyrene microbeads, stabilized by sulfate charges, are added to an alkaline paper stock containing 25% $CaCO_3$ and 5 lbs/ton of cationic starch in the furnish. Table XXIII sets forth the additives used and drainage times measured.

TABLE XXIII

| Cationic Polymer lbs/Ton | Anionic Polystyrene Microbeads lbs/Ton | Drainage Sec. |
|---|---|---|
| -0- | -0- | 103.9 Sec. |
| 1.0 - 10 AETMAC/90 AMD | -0- | 91.6 Sec. |
| 1.0 - 10 AETMAC/90 AMD | 5.0 - Polystyrene beads - 98 nm | 79.8 Sec. |
| 1.0 - 10 AETMAC/90 AMD | 5.0 - Polystyrene beads - 30 nm | 49.9 Sec. |
| 1.0 - 10 AETMAC/90 AMD | 5.0 - Polystyrene beads - 22 nm | 42.2 Sec. |

It is noted that all three anionic polystyrene microbeads improved drainage time over the cationic polymer alone with the smallest bead being the most effective.

The results indicate that noncross-linked, polymeric, water-insoluble microbeads are effective in increasing drainage rates.

EXAMPLE 24

A 30 nm polystyrene bead is compared to bentonite inperformance using the alkaline paper stock containing 5.0 lbs/ton of cationic starch, above described in Example 22. Results are set forth in Table XXIV.

TABLE XXIV

| Cationic Polymer lbs/Ton | Anionic Microbead lbs/Ton | Darinage Sec. |
|---|---|---|
| 1.0 - 10 AETMAC/90 AMD | -0- | 70.9 Sec. |
| 1.0 - 10 AETMAC/90 AMD | 5.0 - Bentonite | 28.5 Sec. |
| 1.0 - 10 AETMAC/90 AMD | 5.0 - Polystyrene Beads - 30 nm | 30.5 Sec. |

The results indicate that the 30nm polystyrene is substantially equivalent to bentonite.

EXAMPLE 25

Microbead size of anionic polymer is studied by measuring drainage rates on the alkaline paper stock of Example 23 to which the additives of Table XXV are added. Results are specified therein.

TABLE XXV

| Cationic Polymer lbs/Ton | Anionic Microbead lbs/Ton | Drainage Sec. |
|---|---|---|
| 1.0 - 10 AETMAC/90 AMD | -0- | 106.8 Sec. |
| 1.0 - 10 AETMAC/90 AMD | 0.5 - 30 AA/70 AMD/ 349 ppm BMA - 130 nm | 72.2 Sec. |
| 1.0 - 10 AETMAC/90 AMD | 2.0 - 40 AA/60 MBA - 220 nm | 71.7 Sec. |
| 1.0 - 10 AETMAC/90 AMD | 0.5 - 30 AA/70 AMD/ | 98.9 Sec. |

TABLE XXV-continued

| Cationic Polymer lbs/Ton | Anionic Microbead lbs/Ton | Drainage Sec. |
|---|---|---|
| | 50 ppm MBA - 1,000–2,000 nm | |
| 1.0 - 10 AETMAC/90 AMD | 2.0 - 30 AA/70 AMD/ 50 ppm MBA - 1,000–2,000 nm | 103.6 Sec. |

Both the 130 nm and 220 nm in diameter microbeads reduce drainage times over that of stock without microbeads by 33%. However, when the diameter of the anionic microbead is increased to 1,000 to 2,000 nm, drainage is not significantly effected.

EXAMPLE 26

Using the same paper stock as in Example 22 the ingredients shown in Table XXVI are added in successive order, as in the previous examples. The results are specified.

TABLE XXVI

| Cationic Polymer lbs/Ton | Anionic Microbeads lbs/Ton | Drainage Sec. |
|---|---|---|
| -0- | -0- | 135.6 Sec. |
| 1.0 - 55 AETMAC/45 AMD | -0- | 99.6 Sec. |
| 1.0 - 55 AETMAC/45 AMD | 0.5 - 30 AA/70 AMD 1000 ppm MBA- 2% surfactant- 464 nm | 86.7 Sec. |
| 1.0 - 55 AETMAC/45 AMD | 0.5 lbs 30 AA/70 AMD/ 1,000 ppm MBA- 4% surfactant- 149 nm | 59.3 Sec. |
| 1.0 - 55 AETMAC/45 AMD | 0.5 lbs 30 AA/70 AMD/ 1,000 ppm MBA- 8% surfactant 106 nm | 54.5 Sec. |

Increased drainage rate is achieved as the microbead becomes smaller. Compared to the drainage time of 99.6 seconds without microbeads, the 464nm microbead results in a 12.9% reduction and the 149nm microbead a 40% reduction, showing the effect of small diameter organic microparticles.

EXAMPLE 27

To the same stock that was used in Example 23, the ingredients set forth in Table XXVII are added, as in said example.

TABLE XXVII

| Cationic Polymer lbs/ton | Anionic Microbeads lbs/Ton | Drainage Sec. |
|---|---|---|
| 1.0 - 10 AETMAC/90 AMD | 0.5 - 30 AA/70 AMD/ 349 ppm MBA - 130 nm | 66.3 |
| 1.0 - 10 AETMAC/90 AMD | 0.5 - 30 APS/70 AMD/ 995 ppm MBA SV-1.37 mPa.s | 67.0 |

The microbeads of the 30 AA/70 AMD/349 ppm MBA copolymer and those of the 30 APS/70 AMD/995 ppm MBA copolymer when used with cationic polymers, produces paper with almost identical drainage times, even though one has a carboxylate and the other has a sulfonate functional group. That the anionic beads have different chemical compositions and a differing degree of cross-linking yet yield similar properties is attributed to this similar charge densities and similar particle size. The acrylic acid microbead has a diameter of 130 nm and the 2-acrylamido-2-methylpropane sulfonic acid microbead is of a similar size due to the similar way it was made.

EXAMPLE 28

The effect of different shear conditions on the relative performance of the anionic microbead compared to bentonite is shown in Tables XXVII A & B. Drainage testing is carried out as described in Example 1, on an alkaline furnish containing 5.0 lbs. of cationic starch subjected to four different shear conditions.

TABLE XXVIII-A

| Condition | Stirring R.P.M. and Time* Cationic Polymer | Microbead |
|---|---|---|
| A | 800 rpm-30 sec. | 800 rpm-30 sec. |
| B | 1,500 rpm-30 sec. | 800 rpm-30 sec. |
| C | 1,500 rpm-60 sec. | 800 rpm-30 sec. |
| D | 1,500 rpm-60 sec. | 1,500 rpm-5 sec. |

High molecular weight cationic polymer is added to the furnish in a vaned Britt jar under agitation and agitation is continuous for the period specified before the microbead is added as in Example 1, agitation is continued, and the drainage measurement taken.

TABLE XXVIII-B

| Cationic Polymer | Anionic Microbead | Drainage in Seconds Shear Conditions A | B | C | D |
|---|---|---|---|---|---|
| 0.6 lbs. 10 AETMAC/90 AMD | 5.0 lbs. Bentonite | 52.6 | 56.1 | 57.8 | 49.6 |
| 0.6 lbs.* 10 AETMAC/90 AMD | 0.5 lbs. 30AA/ 70 AMD-349 ppm MBA-130 nm. | 45.9 | 48.3 | 52.3 | 44.5 |

*5.0 lbs. of alum is added immediately before the cationic polymer.

The relative performance of each additive system remains the same under different test shear conditions.

EXAMPLE 29

The utility of polymeric anionic microbeads in acid paper stock is established as follows. To an acid paper stock made from ⅔ chemical pulp ⅓ ground wood fiber, and containing 15% clay and 10 lbs/ton of alum at a pH of 4.5 are added and the listed ingredients of Table XXIX below.

TABLE XXIX

| Anionic Microbead lbs/Ton | Drainage using Cationic Polymer 10 AETMAC/ 90 AMD 0.5 lbs/Ton | Drainage using Cationic Polymer 10 AETMAC/ 90 AMD 1.0 lbs/Ton |
|---|---|---|
| -0- | 64.2 Sec. | 52.2 Sec. |
| 5.0 - Bentonite | 57.0 Sec. | 47.0 Sec. |
| 0.5 - 30 AA 70 AMD/ 349 ppm MBA - 130 nm | 53.3 | 42.1 Sec. |
| 1.0 - 30 AA/70 AMD/ 349 ppm MBA - 130 nm | — | 38.7 Sec. |

Thus, in acid paper processes,0.5 lb of polymeric anionic microbeads is superior to 5.0 lbs of bentonite in increasing drainage. At a level of 1.0 lbs/ton of cationic polymer, 5.0 lb/ton of bentonite lowers drainage time 10% while 0.5 lb/ton of microbeads lowers it 19.3% and 1.0 lb/ton of microbeads lowers it 25.9%.

EXAMPLE 30

This example demonstrates the effect of alum on drainage in the acid paper process when acid stock from Example 29 is used without initial alum addition. A set of drainage times is measured for this stock without alum present and a second series is measured with 5.0 lbs/ton of added alum and with the ingredients set forth in Table XXX. The enhancement of drainage time with the added alum is a significant advantage of the present invention.

TABLE XXX

| Cationic Polymer lbs/Ton | Anionic Microbead lbs/Ton | Drainage in Seconds Alum in Stock -0- | 5 lbs/Ton |
|---|---|---|---|
| 1.0 - 10 AETMAC/ 90 AMD | 5.0 - Bentonite | 43.0 | 43.5 |
| 1.0 - 55 AETMAC/ 45 AMD | 1.0 - 30 AA/70 AMD/ 349 ppm MBA - 130 nm | 42.1 | 29.1 |

C = Comparative Test

EXAMPLE 31

In recent years cationic potato starch and silica have been found to give improved drainage times when used in alkaline papermaking processes. The effectiveness of polymeric microbeads compared to the silica system is shown in Table XXXI using the ingredients set forth therein on to the alkaline paper stock of, and in accordance with, Example 1.

TABLE XXXI

| Cationic Potato Starch lbs/Ton | Alum* lbs/Ton | Anionic Microbead lbs/Ton | Drainage Seconds |
|---|---|---|---|
| 0 | 0 | 0 | 119.1 |
| 15-Starch | 0 | 0 | 112.7 |
| 15-Starch | 5.0 | 0 | 84.3 |
| 15-Starch | 5.0 | 3.0-Silica-5 nm | 38.5 |
| 15-Starch | 5.0 | 1.0–30 AA/70 AMD/ 349 ppm MBA-130 nm | |
| 30-Starch | 0 | 3.0-Silica-5 nm | 46.3 |

*Alum is added immediately before the addition of cationic potato starch.

The addition of 15 lbs/ton of starch, 5 lbs/ton of Alum and 3.0 lbs/ton of silica reduces the drainage time 67.7%, however replacement of the silica with 1.0 lb/ton of organic anionic microbeads reduces the drainage time 69.2% which is slightly better than the silica system with far less added material.

EXAMPLE 32

The polymeric, anionic microbead and the silica starch systems of Example 31 are compared for first pass retention values using the alkaline paper stock of Example 2. The results are shown in Table XXXII, below.

TABLE XXXII

| Cationic Potato Starch lbs/Ton | Alum* lbs/Ton | Anionic Microparticle lbs/Ton | First Pass Retention % |
|---|---|---|---|
| 0 | 0 | 0 | 25% |
| 15-Starch | 0 | 3.0-Silica 5 nm | 31.7% |
| 15-Starch | 2.5 | 0.5–30 AA/70 AMD/ 349 ppm MBA-130 nm | 37.4% |
| 15-Starch | 2.5 | 1.0–30 AA/70 AMD/ 349 ppm MBA-130 nm | 46.6% |

*Alum is added immediately before the addition of cationic potato starch.

The retention values of starch and 3.0 lbs/ton of silica are surpassed by replacing the silica with 2.5 lbs/ton alum and either 0.5 lbs/ton of microbead or 1.0 lb/ton of microbeads. The process of the instant invention results in a 15.25% and a 34.1% improvement in retention values, respectively, over silica.

EXAMPLE 33

Retention values using silica and the organic anionic microbead of Table XXXIII are compared in a pilot Fourdrinier papermaking machine. The paper stock consists of pulp made from 70% hardwood and 30% softwood containing 25% calcium carbonate and 5 lbs/ton of cationic starch. The cationic potato starch is added immediately before the fan pump. The anionic microbeads and alum are added as in Example 18.

TABLE XXXIII

| Cationic Potato Starch lbs/Ton | Alum lbs/Ton | Anionic Microbead lbs/Ton | Ash Retention % |
|---|---|---|---|
| 0 | 0 | 0 | 34.4 |
| 20 | 0 | 3.0-Silica 5 nm | 49.2 |
| 20 | 5.0 | 3.0-Silica 5 nm | 66.3% |
| 20 | 5.0 | 1.0–30 AA/70 AMD 349 ppm MBA-150 nm SV-1.32 | 68.7% |

Alum improves the retention values of silica and the alum/silica system retention of 66.3% is slightly less than that of the alum/organic anionic microbead system of 68.7% (3.5% improvement) with 166 the concentration of microbead.

EXAMPLE 34

A comparison of drainage times between the anionic, organic, microbead system and the silica system is made using the paper stock described in Example 13. It is noted that this stock contains 16 lbs/ton of cationic potato starch and 6 lbs/ton of alum. The additives of the Table XXXIV are added in successive runs.

TABLE XXXIV

| Cationic Potato Starch lbs/Ton | Alum** lbs/Ton | Anionic Microparticle lbs/Ton | Drainage Seconds |
|---|---|---|---|
| 15 | 0 | 3.0-Silica 5 nm | 42.5 |
| 15* | 0 | 3.0-Silica 5 nm | 55.6 |
| 15 | 2.5 | 1.0–30 AA/70 AMD/ 349 ppm MBA-130 nm | 28.7 |

**Alum is added immediately before the addition of cationic potato starch.
(*Reverse addition of silica before starch)

The silica/starch system is inferior in drainage time to that of the organic microbead system (1.0 lb and 2.5 lbs alum).

EXAMPLE 35

With the same stock as in Example 34, organic, anionic, microbead and silica systems, using a anionic polymer added to the furnish, are compared as to drainage times as in said Example. Alum and cationic starch are added where indicated and the furnish is stirred at 800 r.p.m. for 30 seconds. The anionic acrylamide copolymers and, if added, silica or microbeads are added together to the furnish and stirred for a further 30 seconds at 800 r.p.m. before the drainage rate is measured. See Table XXXV.

TABLE XXXV

| Anionic Polymer Retention Aid lbs/Ton | Alum* lbs/Ton | Anionic Microbead lbs/Ton | Drainage Seconds |
|---|---|---|---|
| 0 | 0 | 0 | 92.4 |
| 0.3-30 AA/70 AMD | 0 | 0 | 62.1 |
| 0.3-30 AA/70 AMD | 5.0 | 0 | 59.4 |
| 0.3-30 AA/70 AMD | 0 | 0.5-Silica-5 nm | 50.4 |
| 0.3-30 AA/70 AMD | 0 | 1.0-Silica-5 nm | 47.5 |
| 0.3-30 AA/70 AMD | 5.0 | 0.5-30 AA/70 AMD/349 ppm MBA-130 nm | 42.2 |
| 0.3-30 AA/ 70 AMD and 10-additional cationic starch | 0 | 1.0-Silica-5 nm | 41.3 |
| 0.3-30 AA/ 70 AMD and 10 additional cationic starch | 5.0 | 0.5-30 AA/70 AMD/349 ppm MBA-130 nm | 28.4 |

*Alum is added immediately before the addition of cationic potato starch, where both one used.

Silica improves drainage times when compared to the anionic acrylamide polymer alone; however, the anionic organic microbeads, in replacing the silica, give even better drainage times with alum. Additional cationic potato starch in the furnish allows the microbead system to produce even faster drainage times.

EXAMPLE 36

Comparative retention values are determined for an organic anionic microbead versus a silica system using an anionic polymer and the paper stock of Example 13. The additives, as specified in Table XXXVI, are added as in Example 35.

TABLE XXXVI

| Anionic Polymer lbs/Ton | Alum lbs/Ton | Anionic Microbead lbs/Ton | First Pass Retention % |
|---|---|---|---|
| 0.3-30 AA/70 AMD | 0 | 0 | 34.3 |
| 0.3-30 AA/70 AMD | 5.0 | 0 | 37.3 |
| 0.3-30 AA/70 AMD | 0 | 1.0-Silica-5 nm | 34.0 |
| 0.3-30 AA/70 AMD | 0 | 0.5-30 AA/70 AMD/349 ppm MBA-130 nm | 40.3 |
| 0.3-30 AA/70 AMD | 5.0 | 0.5-30 AA/70 AMD 349 ppm MBA-130 nm | 52.6 |

Retention values with 0.3 lb/ton of anionic polymer, with and without silica, are identical at 34% and addition of 5.0 lbs/ton of alum and no silica actually increases retention to 37.3%.

Anionic polymers, in combination with organic anionic microbeads however, give better retention values without (40.3%) and with alum (52.6%) when compared to the silica system (34%). This retention when combined with the faster drainage rates of the organic anionic microbeads shown in Table XXXV, makes them preferable to either the silica or bentonite systems usually used commercially.

EXAMPLE 37

The effect of cationic organic, microbeads is now examined. To an alkaline furnish containing 25% calcium carbonate, 15 lbs. of cationic starch and 5 lbs. of alum and of a pH of 8.0, the ingredients of Table XXXVII are added. The anionic polymer is added first and the cationic, organic microbead is added second.

TABLE XXXVII

| Anionic Polymer (Linear) lbs/Ton | Cationic Microbead or Polymer lbs/Ton | Drainage Seconds |
|---|---|---|
| -0- | -0- | 142.7 |
| 0.5 - 30 AA/70 AMD | -0- | 118.5 |
| 0.5 - 30 AA/70 AMD | 0.5 - 40 AETMAC/60 AMD/ 100 ppm MBA- 100 nm | 93.3 |
| 0.5 - 30 AA/70 AMD | 0.5 - 40 AETMAC/60 AMD/ 100 ppm MBA - 1,000 nm | 113.9 |
| 0.5 - 30 AA/70 AMD | 0.5 - 40 AETMAC/60 AMD/ linear Polymer (not a microbead) | 98.7 |

The addition of 0.5 lb/ton of cross-linked cationic microbead—100 nm results a drainage time reduction of 25.2%. Addition of 0.5 lb/ton of linear cationic polymer causes a drainage time reduction but is not as effective as the cationic microbeads of the present invention.

EXAMPLE 38

To an acid paper stock made from ⅔ chemical pulp, ⅓ ground wood fiber and 15% clay are added 20 lbs/ton of alum. Half the stock is adjusted to pH 4.5 and remainder is adjusted to pH 5.5. The ingredients shown in Table XXXVIII are added in the same order as Example 37.

TABLE XXXVIII

| Anionic Polymer lbs/Ton | Cationic Polymer lbs/Ton | Cationic Microbead lbs/Ton | Drainage Time In Seconds pH 4.5 | pH 5.5 |
|---|---|---|---|---|
| -0- | -0- | -0- | 103.4 | — |
| 0.5-7 AA/93 AMD | -0- | -0- | 88.4 | 59.8 |
| 0.5-10 APS/90 AMD | -0- | -0- | 95.0 | 59.7 |
| -0- | 0.5-10 AETMAC/90 AMD | -0- | 69.5 | 73.3 |
| -0- | 0.5-40 AETMAC/60 AMD | -0- | 72.9 | 69.4 |
| -0- | -0- | 0.5-40 AETMAC/60 AMD/ 100 ppm MBA-100 nm | 74.0 | 74.7 |
| -0- | -0- | 0.5-40 AETMAC/60 AMD/ 100 ppm MBA-1,000 nm | 94.6 | 92.8 |
| 0.5-7 AA/93 AMD | 0.5-40 AETMAC/60 AMD | -0- | 65.2 | 56.0 |
| 0.5-7 AA/93 AMD | -0- | 0.5-40 AETMAC/60 AMD/ 100 ppm MBA-100 nm | 70.5 | 53.4 |
| 0.5-7 AA/93 AMD | -0- | 0.5-40 AETMAC/60 AMD/ 100 ppm MBA-1,000 nm | 92.7 | 62.8 |
| 0.5-10 APS/90 AMD | 0.5-40 AETMAC/60 AMD | -0- | 72.3 | 55.4 |
| 0.5-10 APS/90 AMD | -0- | 0.5-40 AETMAC/60 AMD/ 100 ppm MBA-100 nm | 74.9 | 54.5 |
| 0.5-10 APS/90 AMD | -0- | 0.5-40 AETMAC/60 AMD/ | 99.7 | 70.7 |

TABLE XXXVIII-continued

| Anionic Polymer lbs/Ton | Cationic Polymer lbs/Ton | Cationic Microbead lbs/Ton | Drainage Time In Seconds pH 4.5 | pH 5.5 |
|---|---|---|---|---|
| | | 100 ppm MBA-1,000 nm | | |

EXAMPLES 39–45

Following the procedure of Example 2, various microbeads, high molecular weight (HMN) polymers and polysaccharides are added to paper-making stock as described therein. In each instance, similar results are observed.

| Example No. | Microbead | Polysaccharide | HMW Polymer |
|---|---|---|---|
| 39 | AM/MAA (50/50) | Cationic Guar | AM/DADM (70/30) |
| 40 | AM/VSA (65/35) | — | Mannich PAM |
| 41 | Mannich PAM | CMC | AM/AA (80/20) |
| 42 | AM/DADM (75/25) | — | PAA |
| 43 | P(DMAEA) | — | — |
| 44 | P(AA) | Cationic Guar | AM/DMAEA |
| 45 | AM/AA (25/75) | Cationic Guar | AM/AA (70/30) |

AM = Acrylamide
MAA = Methacrylic acid
VSA = Vinyl Sulfonic acid
DADM = Diallydimethylammonium chloride
P(AA) = Polyacrylic acid
P(DMAEA) = Poly(dimethylaminoethylacrylate) quaternary
CMC = Carboxymethyl cellulose
Mannich PAM = Polyacrylamide reacted with formaldehyde and diemthyl amine

We claim:

1. A method of making paper which comprises adding to an aqueous paper furnish from about 0.05 to about 20 lbs/ton, based on the dry weight of paper furnish solids, of an ionic, organic, cross-linked polymeric microbead, the microbead having an unswollen particle diameter of less than about 750 nanometers and an ionicity of at least 1%, but at least 5%, if anionic and used alone.

2. Paper produced by the method of claim 1.

3. A method according to claim 1 wherein from about 0.05 to about 20 lbs/ton, same basis, of a high molecular weight, ionic polymer is added to said furnish in conjunction with said microbead.

4. Paper produced by the method of claim 3.

5. A method according to claim 3 wherein the microbead and the high molecular weight ionic polymer have opposite charges.

6. Paper produced by the method of claim 5.

7. A method according to claim 3 wherein said ionic polymer is anionic.

8. Paper produced by the method of claim 7.

9. A method according to claim 3 wherein said ionic polymer is cationic.

10. Paper produced by the method of claim 9.

11. A method according to claim 1 wherein from about 1.0 to about 50 lbs/ton, same basis, of an ionic polysaccharide is added to said furnish in conjunction with said microbead.

12. Paper produced by the method of claim 11.

13. A method according to claim 11 wherein said polysaccharide is cationic.

14. Paper produced by the method of claim 13.

15. A method according to claim 11 wherein said polysaccharide is anionic.

16. Paper produced by the method of claim 15.

17. A method according to claim 11 wherein the polysaccharide is starch.

18. Paper produced by the method of claim 17.

19. A method according to claim 1 wherein said microbead is a polymer of acrylamide.

20. Paper produced by the method of claim 19.

21. A method according to claim 1 wherein the furnish contains a size, a strength additive a promotor, a polymeric coagulant, a dye fixative or a mixture thereof.

22. Paper produced by the method of claim 21.

23. A method according to claim 1 wherein from about 0.1 to about 20 pounds of an active, soluble aluminum species is also added per ton of paper furnish solids to the furnish.

24. Paper produced by the method of claim 23.

25. A method according to claim 23 wherein the species is alum, polyhydroxyaluminum chloride and/or sulfate or mixtures thereof.

26. Paper produced by the method of claim 25.

27. A method according to claim 1 wherein bentonite or silica is added in conjunction with the microbead.

28. Paper produced by the method of claim 27.

* * * * *